United States Patent [19]

Sato et al.

[11] Patent Number: 5,027,732

[45] Date of Patent: Jul. 2, 1991

[54] THREAD END HOLDING UNIT

[75] Inventors: Shuichi Sato; Shirou Ayusawa, both of Utsunomiya, Japan

[73] Assignee: SSMC Inc., Edison, N.J.

[21] Appl. No.: 437,244

[22] Filed: Nov. 16, 1989

[30] Foreign Application Priority Data

Dec. 5, 1988 [JP] Japan ..... 63-157669[U]

[51] Int. Cl.[5] ..... D05B 65/00

[52] U.S. Cl. ..... 112/286; 112/253

[58] Field of Search ..... 112/286, 285, 253, 252

[56] References Cited

U.S. PATENT DOCUMENTS

| | | | |
|---|---|---|---|
| 434,118 | 8/1890 | Roberts | 112/252 |
| 3,424,117 | 1/1969 | Schopf | 112/292 |
| 3,494,316 | 2/1970 | Ross | 112/253 |
| 3,747,548 | 7/1973 | Brophy | 112/293 |
| 4,550,672 | 11/1985 | Kastrup | 112/253 |

FOREIGN PATENT DOCUMENTS

| | | | |
|---|---|---|---|
| 2279876 | 2/1976 | France | 112/295 |
| 2588577 | 4/1987 | France | 112/285 |
| 0071773 | 4/1984 | Japan | 112/285 |
| 0168486 | 8/1985 | Japan | 112/285 |
| 2095398 | 9/1990 | Japan | 112/286 |

*Primary Examiner*—Werner H. Schroeder
*Assistant Examiner*—Sullivan C. Prak
*Attorney, Agent, or Firm*—Theodore Jay

[57] ABSTRACT

A thread end holding unit of a sewing machine employs a needle thread gripping puller driven so as to be positioned either at a thread catch position or a return position. The puller has a hook portion at a tip end thereof adapted for catching a needle thread extended from a needle when the needle thread gripping puller is positioned at the thread catch position. The needle thread is caught and held by the hook at the return position. First and second holding members are respectively fixedly mounted on a supporter fixed to the arm. These holding members have press portions forcibly pushed elastically by both sides of the needle thread gripping puller for pressing and holding the thread end of the needle thread caught by the hook when the hook portion is positioned at the return position.

1 Claim, 4 Drawing Sheets

THREAD END HOLDING UNIT

BACKGROUND OF THE INVENTION

1. Field of the Invention

The present invention relates to a thread end holding unit of a sewing machine.

2. Description of the Prior Art

A thread end holding unit of the sewing machine has the function of cutting off a needle thread and a bobbin thread under a processed cloth upon completion of sewing the processed cloth, by drawing the thread end at the upper side of the processed cloth, and holding the thread end thereby preventing the thread end from being entangled in a form similar to a bird's nest at the rear portion of the processed cloth.

A prior art thread end holding unit is disclosed in Japanese Utility Model Laid-Open Publication No. 61-157487. This unit employs a needle thread gripping puller provided at the side of an arm of the sewing machine which is driven to reach a catch position or a return position. The puller has a hook portion for catching the needle thread extending downward from the needle toward the processed cloth in the catch position and holding it in the return position. A holding member having a base end portion fixed to the side of the arm of the sewing machine and a tip end portion for contacting the needle thread gripping puller to press and hold the thread end of the needle thread caught by the hook portion at the time when the needle thread gripping puller takes the return position.

However, this prior art thread end holding unit was found to be subject to an undesirable condition wherein the thread end of the needle thread caught by the hook of the needle thread gripping puller is pressed and held by a single holding member. The rigidity of both the needle thread gripping puller and the holding member must be increased to increase the holding force of the needle thread. Inasmuch as the needle thread is pressed and held by the friction force generated at the narrow portion between the needle thread gripping portion and the holding member, it is easy for the needle thread to be dropped.

Japanese Utility Model Laid-Open Publication No. 62 -109079 discloses a structure wherein the needle thread cutting unit has a cutting knife for cutting off a thread end of the needle thread at the side of the processed cloth held by the thread end holding unit at the same time of starting the sewing of the processed cloth. This arrangement is subject to erroneous performance of the needle thread cutting unit. This problem arises because the needle thread cutting unit employs a structure for cutting off thread end of the needle thread held by the thread end holding unit during the movement of the processed cloth. The thread end holding unit causes a tension in the thread end of the needle thread which dulls the sharpness of the blade cutting the needle thread. When the knife is so dulled, the thread end holding unit must apply a strong holding force in order to maintain a suitable thread cutting operation.

SUMMARY OF THE INVENTION

It is therefore a primary object of the present invention to provide a thread end holding unit of a sewing machine which will firmly hold a thread end of a needle thread.

Another object of the present invention is to provide a thread end holding unit of a sewing machine which will increase the holding force of the thread end of the needle thread.

Yet another object of the present invention is to provide a thread end holding unit of a sewing machine which overcomes the problems of the prior art devices by the mere addition of first and second holding members.

To achieve the above objects, the present invention employs a needle thread gripping puller mounted on an arm of the sewing machine. The puller driven so as to be positioned at a thread catch position or a thread return position. The needle thread gripping puller has a hook portion at a tip end thereof for catching a needle thread extended from a needle when the needle thread gripping puller is positioned at the thread catch position. The needle thread is kept caught and held by the hook portion at the return position. First and second holding members are respectively securely mounted on a supporter fixed to the arm. These holding members have press portions forcibly pushed elastically by both sides of the needle thread gripping puller to press and hold the thread end of the needle thread caught by the hook when the hook portion is positioned at the return position.

The above and other objects, features and advantages of the present invention will become more apparent from the following description taken in conjunction with the accompanying drawings.

DESCRIPTION OF THE PREFERRED EMBODIMENT

Figure 1:
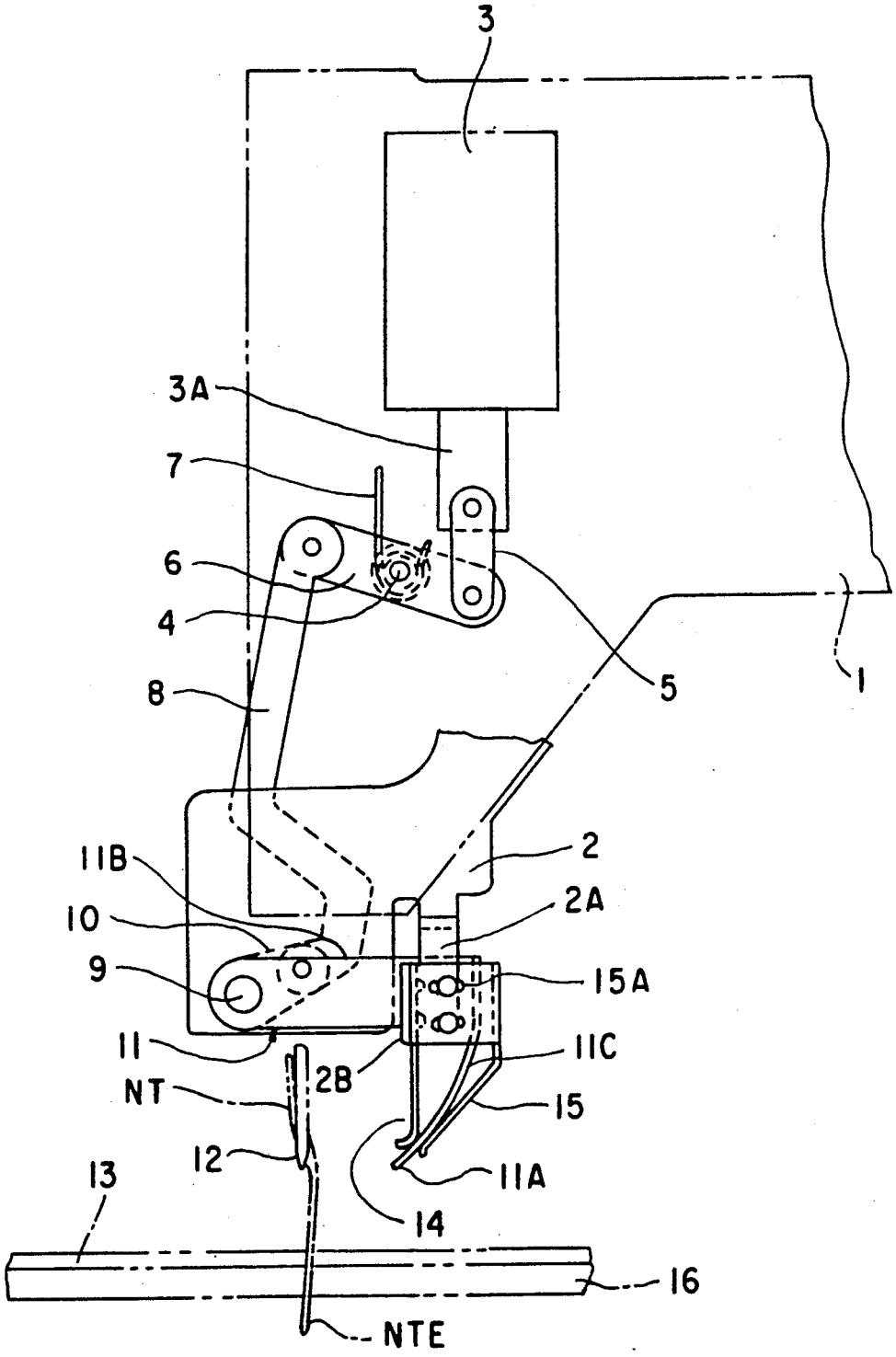
FIG. 1 is a view of a thread end holding unit according to a preferred embodiment of the present invention.
Figure 2:
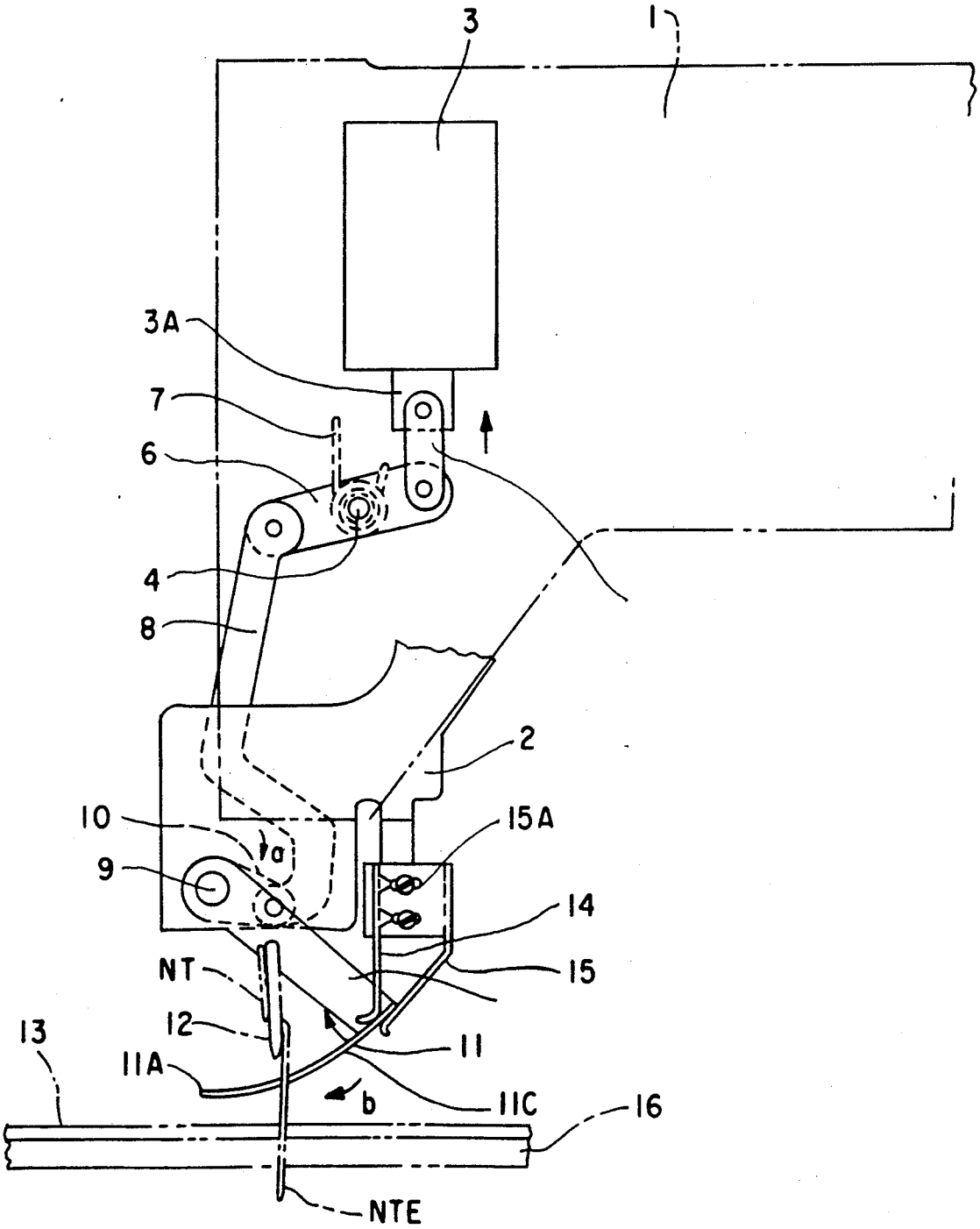
FIGS. 2 and 3 are views illustrating operations of the thread end holding unit of FIG. 1.

A thread end holding unit according to a preferred embodiment of the present invention will be described with reference to FIGS. 1 to 5.

The thread end holding unit of a sewing machine comprising a needle thread gripping puller 11 mounted on an arm 11B of the sewing machine. Puller 11 is driven so as to be positioned at a thread catch position or a return position. Puller 11 has a hook portion 11A at the tip end thereof capable of catching a needle thread extended from a needle when the needle thread gripping puller 11 is positioned at the thread catch position, while the needle thread is retained and held by the hook portion 11A at the return position. First and second holding members 14, 15 are respectively securely mounted on a supporter fixed to the arm 11B. Members 14, 15 have press portions 14B, 15B forcibly pushed elastically by both sides of the needle thread gripping puller 11 for pressing and holding the thread end of the needle thread caught by the hook when the hook portion 11A is positioned at the return position.

The arrangement will be described more in detail hereinafter.

Attached to the supporting plate 2 fixed to the rear surface of the chin portion of the arm 1 is solenoid 3 having plunger 3A which is telescopically drivable upon the reception of the electric signal issued by a control unit (not shown). The tip end portion of the plunger 3A of the solenoid 3 is connected to one end of the connection link 5. Link 6 is supported by the supporting shaft 4 at a middle portion thereof by the supporting plate 2 via connection link 5. One end of supporting shaft 4 is held by the swing link 6, and the other end is always urged by the coil spring 7 held by the supporting plate 2 so that the plunger 3A takes a return position. The end portion of the swing link 6 remote from link 5 is connected to one end of the operation link 8 while the other end of the operation link 8 is connected to the tip end portion of the operation crank 10 by a pin. The base end portion of the operation crank 10 is secured to the needle thread gripping puller shaft 9 which rotatably projects from the supporting plate 2 while the needle thread gripping puller shaft 9 has the needle thread gripping puller 11 fixed thereto. The needle thread gripping puller 11 is substantially L-shaped and has a base end portion composed of the arm 11B secured to the needle thread gripping puller shaft 9 and a circular arc portion 11C connected to the tip end of the arm 11B and forming the shape of a circular arc about the needle thread gripping puller shaft 9. The tip end portion of the circular arc portion 11C has hook portion 11A for catching the needle thread end NTE of the needle thread NT. A stitch is formed on the processed cloth 13 by the needle thread NT threaded into the needle hole of the needle 12. Needle 12 is vertically movable in the arm 11B and the bobbin thread holder (not shown).

In a normal state where the needle thread gripping puller 11 assumes the return portion shown in FIG. 1, the tip end of the arm 1 is positioned in the bracket 2B of the supporting plate 2 and the plunger 3A is moved from the return position to the thread catch position. The hook portion 11A crosses the vertically reciprocating movement path of the needle 12 so that the hook portion 11A holds and catches the needle thread end NTE of the needle thread NT which extends along the vertically reciprocating movement path.

The supporting plate 2 has arm 2A at the lower end portion thereof. Arm 2A supports bracket 2B. The bracket 2B has an inner side surface to which the base end portion of the first holding member 14 is fixed and an outer side surface to which base end portion of the second holding member 15 is fixed. The first holding member 14 is a coil spring with two slits 14A extending vertically. Spring 7 has a tip end portion bent in L-shape which has a press portion 14B of downward convexed circular arc shape. The first holding member 14 is disposed so that the press portion 14B is positioned at the upper side of the circular arc portion 11C of the needle thread gripping portion 11. The vertically directional fixing position can be adjusted by use of the slit 14A, whereby the contact pressure force of the press portion 14B engaging upper surface of the circular arc portion 11C along a line of contact can be set to an appropriate value depending on the thickness of the needle thread NT and the kind of the needle thread NT. The second holding member 15 is also coil spring 7 with a base end portion provided with slit 15A extending rightward and leftward. The tip end portion connected from the base end portion is bent into L-shape. A press portion 15B of the flat plate shape has an inclined surface tip end edge at the side of the needle thread NT for receiving the needle thread NT with east. The second holding member 15 is disposed so that the press portion 15B is positioned under the circular arc portion 11C of the needle thread gripping puller 11. The leftward and rightward fixing portion can be adjusted by the slit 15A, whereby the contact position of the press portion 15B which is pressed and brought into wide surface contact with the lower surface of the circular arc portion 11C of the needle thread gripping puller 11 can be oppositely disposed to the contact position of the press portion 14B of the first holding member 14.

An operation of the thread end holding unit of the present invention will be described hereinafter.

The thread end holding unit is illustrated in FIG. 1 when it is in the state immediately preceding this operation. Upon completion of the series of stitching operations on one piece of the processed cloth, the operator operates a foot pedal (not shown) causing the thread cutting unit (not shown) under the bed 16 to operate so that the needle thread NT and the bobbin thread are cut off under the processed cloth 13. At this point, the needle 12 is close to the top dead point while the needle thread NT is directed from the needle 12 toward the processed cloth 13 and perpendicularly extends along the vertically reciprocating movement path of the needle 12.

An electric signal issued by the control unit is supplied to the solenoid 3 to cause plunger 3A to move downward against the resilient force of the coil spring 7, whereby the swing link 6 is swung about the supporting shaft 4 via connection link permitting the operation link 8 to push down. The operation crank 10 is rotated in the direction of the arrow a together with the needle thread gripping puller shaft 9. As a result, the needle thread gripping puller 11 integrated with the needle thread gripping puller shaft 9 is rotated in the direction of the arrow b. With the rotation of the needle thread gripping puller 11, the hook portion 11A of the needle thread gripping puller 11 passes under the needle 12 positioned close to the top dead point to thereby push and retract the needle thread NT extending along substantially perpendicularly to the vertically reciprocating movement path of the needle 12 and to be swung in maximum and finally reach the thread catch position.

Figure 3:
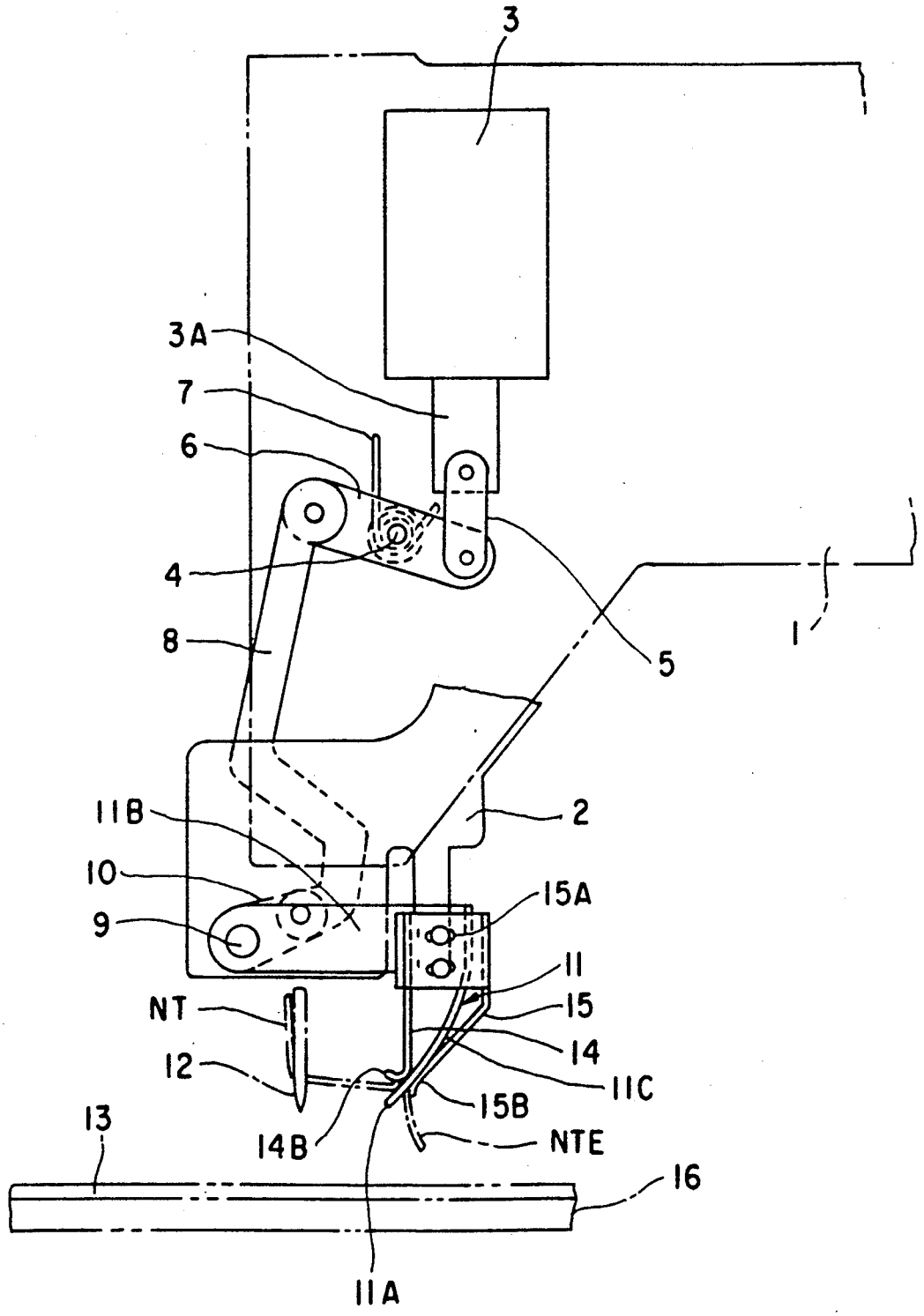

When the electric signal to the solenoid is interrupted the plunger changes position and the needle thread gripping puller 11 effects the return operation via the connection link 5, the swing link 6, the operation link 8, the operation crank 10 and the needle thread gripping puller shaft 9. In the return operation of the gripping puller 11 as illustrated in detail in FIG. 5, the hook portion 11A holds the needle thread end NTE of the needle thread NT perpendicularly downwardly extending from the needle 12 and returns so as to enter between the press portion 14B of the first holding member 14 and the press portion 15B of the second holding member 15 as shown in FIG. 3. With this arrangement, when the needle thread gripping puller 11 takes the return position, hook portion 11A is elastically pressed and brought into contact at the upper and lower both surfaces with the press portions 14B and 15B whereby the needle thread NT is held and caught by the hook portion 11A to form the bent shape and the both sides of the needle thread end NTE are held by press portion 14B and 15B.

Figure 4:
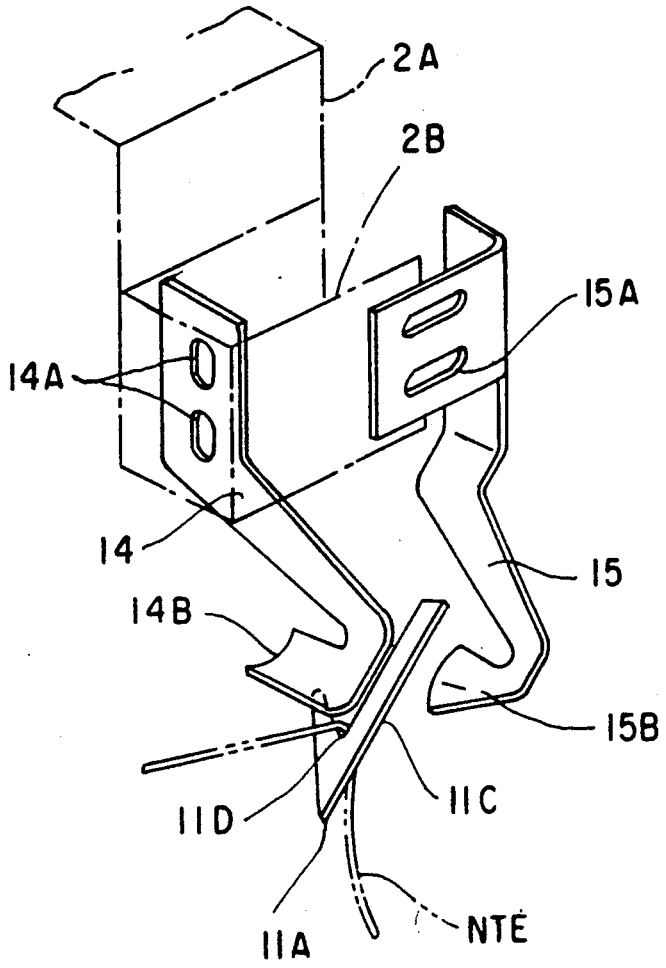
FIG. 4 is a perspective exploded view of first and second holding members utilized in the structure of FIG. 1.
Figure 5:
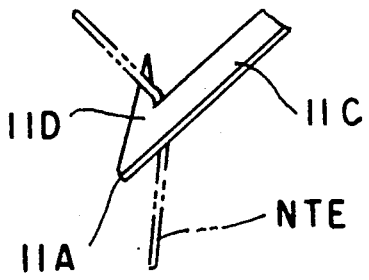
FIG. 5 is a view illustrating operation of a hook portion of a needle thread gripping puller employed in the structure of FIG. 1.

Consequently, inasmuch as the needle thread end NTE of the needle thread NT caught by the hook portion 11A is pressed by the press portion 14B at the upper surface of the hook portion 11A and pressed by the press portion 15B at the lower surface of the second holding member 15A while the bent portion of the needle thread NT enters, as shown in FIG. 4, into a groove portion 11D of the hook portion, the needle thread end NTE receives a greater friction force at the groove portion 11D of the hook portion 11A in addition to the friction force at the press portions 14B and 15B and is firmly held.

The following advantages of the invention are achieved. 1. Inasmuch as the thread end of the needle thread is pressed and held by the both surfaces of the hook portion of the needle thread gripping puller due to the pressing by the press portions of the first and second holding members, the thread end can be firmly held thereby. 2. Inasmuch as the hook portion of the needle thread gripping puller has one side with which the press portion of the first holding member is brought into contact and the other side with which the press portion of the second holding member is brought into contact, the forces of contact applied to one side and the other side are equal and opposite and cancel each other whereby the holding force of the thread end of the needle thread is remarkable increased without increasing the pull of the needle thread gripping puller. 3. As compared with the sewing machine provided with the prior art thread end holding device, the advantages set forth above can be achieved easily with the arrangement substantially adding the first and second holding members to the prior art arrangement, hence the arrangement of the present invention can be applied with ease to the prior art sewing machine.

Although the invention has been described in its preferred form with a certain degree of particularity, it is to be understood that many variations and changes are possible in the invention without departing from the scope thereof.

What is claimed is:

1. A thread end holding unit for a sewing machine having an arm aid comprising:

a needle thread gripping puller mounted on said arm and driven so as to be positioned either at a thread catch position or return position, the needle thread gripping puller having a tip end with a hook tip portion for catching a needle thread extended from a needle when the puller is positioned at the thread catch position wherein subsequently the needle thread being kept caught and held by the hook at the return position; and a first and second holding member respectively fixedly mounted on a supporter fixed to said arm, the first and the second holding members having press portions forcibly pushed elastically by both sides of the needle thread gripping puller for pressing and holding the thread end of the needle thread caught by the hook when the hook portion is positioned at the return position.

* * * * *